US008497632B2

(12) United States Patent
Arimoto et al.

(10) Patent No.: US 8,497,632 B2
(45) Date of Patent: Jul. 30, 2013

(54) SHORT ARC TYPE DISCHARGE LAMP

(75) Inventors: Tomoyoshi Arimoto, Hyogo (JP); Akihiro Shimizu, Hyogo (JP); Mitsuru Ikeuchi, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/348,301

(22) Filed: Jan. 11, 2012

(65) Prior Publication Data

US 2012/0181925 A1 Jul. 19, 2012

(30) Foreign Application Priority Data

Jan. 14, 2011 (JP) ..... 2011-005412

(51) Int. Cl.
*H01J 61/04* (2006.01)

(52) U.S. Cl.
USPC ..... 313/633; 313/352; 313/357

(58) Field of Classification Search
None
See application file for complete search history.

(56) References Cited

U.S. PATENT DOCUMENTS

| | | | | |
|---|---|---|---|---|
| 4,752,713 | A * | 6/1988 | Buxbaum | 313/346 R |
| 5,874,805 | A * | 2/1999 | Kavanagh | 313/631 |
| 2010/0244689 | A1 * | 9/2010 | Kagebayashi et al. | 313/632 |

FOREIGN PATENT DOCUMENTS

JP 2010-033825 A 2/2010

* cited by examiner

*Primary Examiner* — Ashok Patel
(74) *Attorney, Agent, or Firm* — Rader, Fishman & Grauer PLLC

(57) ABSTRACT

A short arc type discharge lamp includes a cathode and an anode arranged inside an arc tube to face each other. The cathode comprises a main body portion made of tungsten and an emitter portion made of thoriated tungsten that is joined at the tip of the main body portion, where a metal oxide other than thorium (Th) is contained in the main body portion of the cathode, and a tungsten carbide layer is formed on the metal oxide.

6 Claims, 3 Drawing Sheets

SHORT ARC TYPE DISCHARGE LAMP

CROSS-REFERENCES TO RELATED APPLICATION

This application claims priority from Japanese Patent Application Serial No. 2011-005412 filed Jan. 14, 2011, the contents of which are incorporated herein by reference in their entirety.

TECHNICAL FIELD

The present invention relates to a short arc type discharge lamp, and especially relates to a short arc type discharge lamp equipped with an emitter portion of a cathode, which contains thorium oxide.

BACKGROUND

In a short arc type discharge lamp that encloses mercury, a distance between the tips of a pair of electrodes, provided to face each other is short. A light source thereof is similar to a point source, so that such a lamp is combined with an optical system for use as a light source of an exposure apparatus with high light collection efficiency. Moreover, a short arc type discharge lamp, in which xenon is enclosed, is used as a visible light-light source of a film projector, and is also used as a light source of a digital cinema. Further, in such a short arc type discharge lamp, emitter material is contained in a cathode to raise electron emission characteristic.

Yet, in view of saving of a scarce resource, there has been a restriction on use of thorium as emitter material. Thus, there is a demand to avoid extensive thorium usage. In addition, since thorium is a radioactive material, there may be legal regulations restricting handling or use. In view of these circumstances, a discharge lamp having the structure, in which only the tip of cathode contains emitter material, has been variously developed. Japanese Patent Application Publication No. 2010-33825 discloses a cathode structure of a short arc type discharge lamp.

FIGS. 3A and 3B show such background art. Specifically, FIG. 3A is a view of a short arc type discharge lamp. FIG. 3B is an enlarged view of a cathode structure. As shown in FIG. 3A, an anode 11 and a cathode 12, which are made of tungsten, are arranged to face each other in an arc tube 10 of the short arc type discharge lamp 1. Light emitting material such as mercury and xenon is enclosed in the arc tube 10. In addition, although FIG. 3A shows the short arc type discharge lamp 1 in which vertical lighting is carried out, such a lamp may be used in horizontal lighting, depending on application. And the cathode structure of the lamp is shown in FIG. 3B, in which the cathode 12 comprises a cathode main body portion 12*b* made of tungsten having high purity, and an emitter portion 12*a* which is integrally formed with the cathode main body 12*b*. Emitter material such as thorium oxide is contained in tungsten of this emitter portion 12*a*.

In such a lamp in which such thorium is used as emitter material, the thorium oxide contained in the thoriated tungsten of a tip portion of the cathode is returned when temperature of the cathode surface is raised during lamp lighting, and it turns into thorium atoms to diffuse in an outer surface of the cathode, thereby moving to a tip side where the temperature is high.

However, in the above-mentioned background art, the emitter material, which actually contributes to an improvement of the electron emission characteristic at time of lamp lighting, is limited to emitter material contained a portion from the outer surface of the tip of the cathode to a very shallow area. Although the emitter material evaporates and is consumed by heat at the outer surface of the tip of the cathode, it is expected that the emitter material is supplied to the outer surface by concentration diffusion from the inside of the cathode. However, supply thereof, which is caused by concentration diffusion from the inside of the cathode whose temperature is low, is not fully made, compared with the consumption amount in the outer surface whose temperature becomes the highest. Thus, the supply amount does not catch up with the consumption amount, and consequently, although the inside of the cathode is rich in emitter material, a phenomenon occurs in which the emitter material is dried on the cathode surface. Further, in the background art, even if such emitter material is contained inside the tip of the cathode, the emitter material is not fully utilized, when the emitter material is dried on the surface of the tip of the cathode. In turn, the electron emission characteristics deteriorate and causes a flicker.

SUMMARY

The present invention relates to a cathode of a short arc type discharge lamp that includes an arc tube with the cathode and an anode are arranged inside to face each other, comprising a main body portion made of tungsten; and an emitter portion made of thoriated tungsten that is joined at the tip of the main body portion, wherein a metal oxide other than thorium (Th) is contained in the main body portion, and wherein a tungsten carbide layer is formed on the metal oxide.

Further, the metal oxide may be formed by applying a metal oxide layer onto a surface of the main body portion or the metal oxide is added to the main body portion.

The described may be embodied in various forms, including projectors, lighting apparatus methods, projection products, display systems, and the like.

BRIEF DESCRIPTION OF THE DRAWINGS

Other features and advantages of the present short arc type discharge lamp will be apparent from the ensuing description, taken in conjunction with the accompanying drawings, in which.

DESCRIPTION

In view of the above, the present invention was made to offer a structure of a short arc type discharge lamp in which a cathode and an anode are arranged to face each other inside an arc tube. The cathode comprises a main body portion made of tungsten and an emitter portion made of thoriated tungsten that is joined at the tip of the main body portion. The emitter material contained inside the tip of the cathode is effectively used thereby preventing depletion of the emitter material in the surface portion of the cathode, and electron-emission performance is maintained for a long time by sufficiently utilizing the emitter material, to compensate the depletion, even if the amount of the emitter material to be used is reduced. Thus, the life span of a lamp may be prolonged.

Further, the cathode main body portion includes metal oxide other than thorium (Th), and a tungsten carbide layer is formed on the metal oxide. The metal oxide may be a metal oxide layer applied to the surface of the main body portion. Furthermore, the metal oxide may be added in the main body portion.

Furthermore, gas such as carbon monoxide (CO) is generated by a reaction of the tungsten carbide with the metal oxide on the surface of the cathode, and it is conveyed through the gas to a tip face of the emitter portion, which contains thorium oxide, and then carbon (C) diffuses inside the cathode, i.e., the emitter portion, whereby a reduction reaction of the thorium oxide inside the emitter portion is facilitated, and the thorium oxide, which is contained inside the cathode, is used effectively. Consequently, depletion of the thorium oxide in the surface of the cathode emitter portion does not occur. Even if the amount of the entire emitter material to be used is limited, a long life span of the lamp with regard to a flicker can still be realized.

Figure 1:
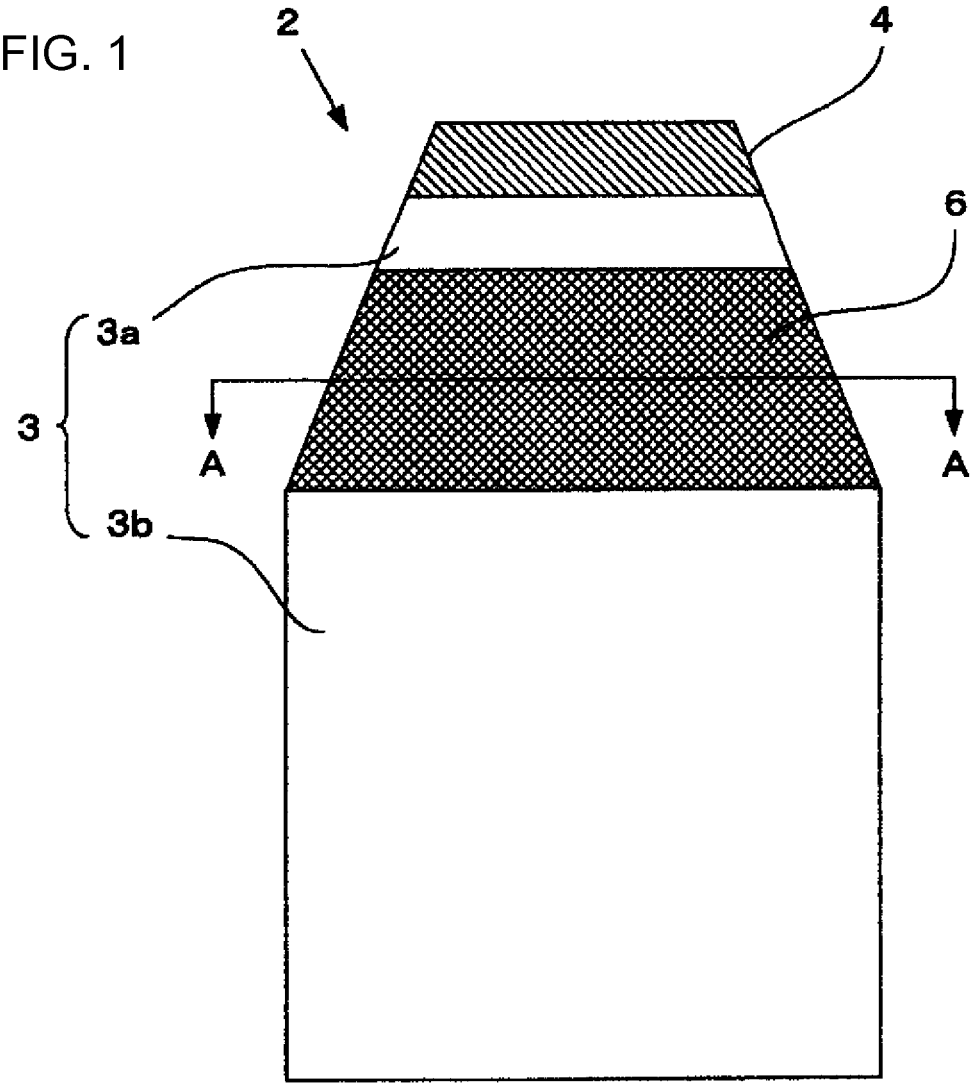
FIG. 1 is a view of a cathode structure of a discharge lamp according to an embodiment.

FIG. 1 is a view of a cathode structure of a discharge lamp according to an embodiment. A cathode 2 comprises a main body portion 3 that is made of tungsten, and an emitter portion 4 that is made of thoriated tungsten and is connected to the tip of the main body portion 3. In addition, it is desirable that the main body portion 3 and the emitter portion 4 be diffusion-bonded. Here, the "diffusion-bonding" means solid-phase bonding in which faces of metals are superimposed to each other, and are heated and pressurized, to the extent that plastic deformation does not occur in a solid state where it is lower than the melting points of the metals, thereby diffusing atoms of the bonded portion. Since the heating temperature is 2,000 degrees Celsius, and it is not necessary to heat it to the melting point of tungsten (about 3,400 degrees Celsius) as in case of fusion joining, the metallographic structure of the main body portion and the emitter portion can be maintained. Thus, there is no adverse effect on the cathode performance. Furthermore, since the metallographic structure of the cathode does not change, there is also an advantage that a cutting operation (processing) may be performed after the main body portion 3 and the emitter portion 4 are joined to each other.

Figure 2:
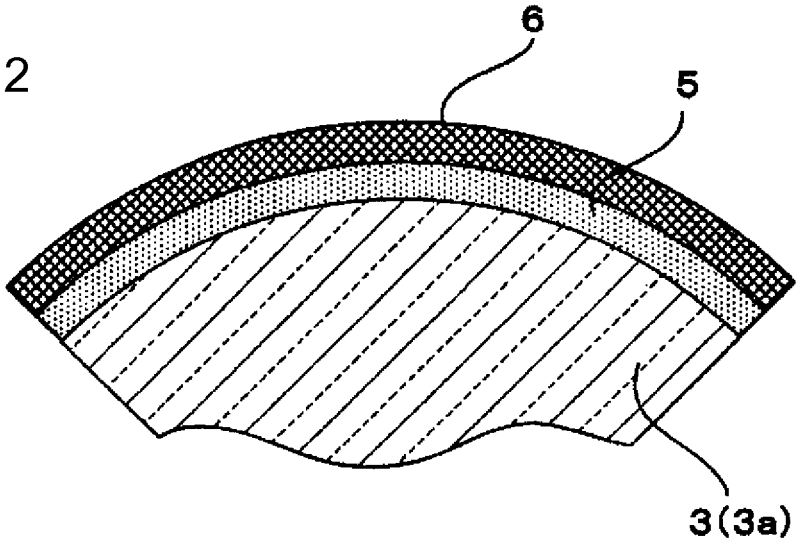
FIG. 2 is a cross sectional view of an embodiment, taken along a line II-II of FIG. 1.
Figure 3A:
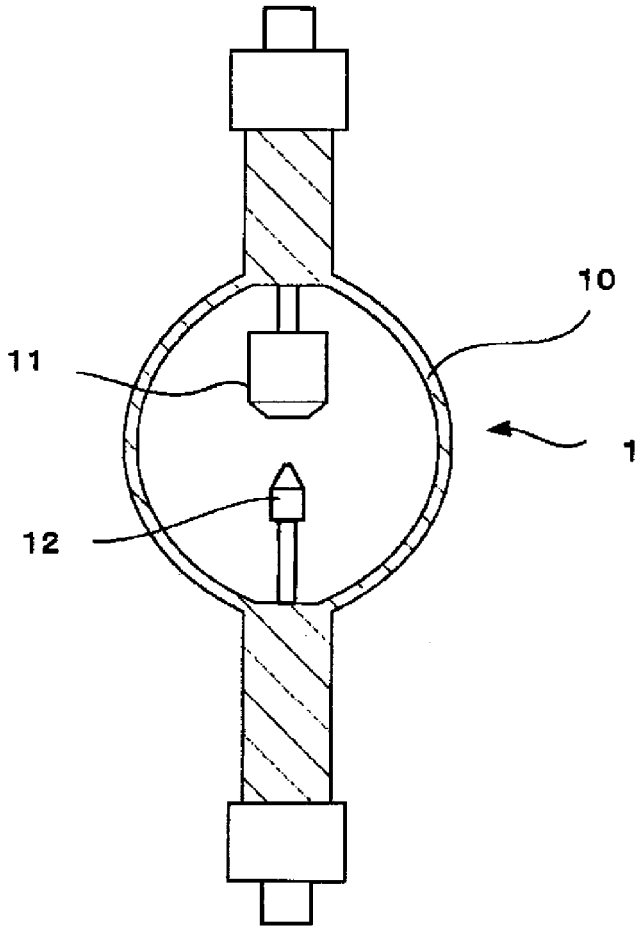
FIG. 3A is a view of a short art type discharge lamp.
Figure 3B:
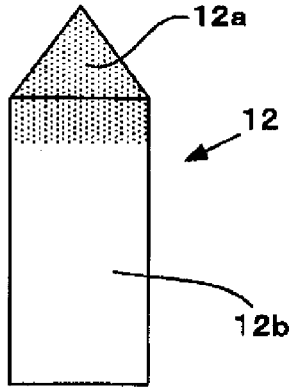
FIG. 3B is an enlarged view of a cathode structure.

The cathode main body portion 3 is made of tungsten and contains metal oxide(s), such as metal other than thorium (Th), for example, zirconium, (Zr), cerium (Ce), lanthanum (La), and yttrium (Y), and a tungsten carbide layer is formed on the metal oxide. FIG. 2 is a cross sectional view of an embodiment, taken along a line II-II of FIG. 1. The cathode main body portion 3, is made of pure tungsten whose purity is, for example, 99.99% by weight or higher. Metal oxide(s) such as zirconium oxide ($ZrO_2$), cerium oxide ($CeO_2$), lanthanum oxide ($La_2O_2$), or yttrium oxide ($Y_2O_2$) is applied to a side surface to form a metal oxide layer 5. A tungsten carbide layer 6 is formed on this metal oxide layer 5.

On the other hand, the emitter portion 4 contains so-called thoriated tungsten (hereafter referred to as Thori-Tun), which contains thorium oxide ($ThO_2$) as emitter material in the tungsten that is the main ingredient, wherein the amount of the thorium oxide to be contained is, for example, 2 wt %. Usually, thorium oxide contained in Thori-Tun which forms this emitter portion 4, is reduced when it reaches high temperature during lamp lighting, thereby producing thorium atoms and diffusing on an outer surface of the cathode, and they move to a tip side thereof where the temperature is high. This improves the electron emission characteristics.

A small diameter portion 3*a* in a taper shape, whose diameter is smaller towards the tip side, is formed at a tip portion of a cylindrical section 3*b* of the main body portion 3. The emitter portion 4 having a truncated cone shape portion is joined to the tip portion, where a tip of the cathode 2 is formed to have a truncated cone shape that is a taper shape as a whole. However, the shape of the small diameter portion 3*a* of the main body portion 3 is not limited to such a taper shape, but may be an arc shape. Moreover, the tip of the emitter portion 4 may be the so-called shell type arc shape. Furthermore, although the above example, in which the emitter portion 4 is joined to the small diameter portion 3*a* of the main body portion 3, is described, the emitter portion 4 may be joined to the cylindrical section 3*b* of the main body portion 3, depending on the shape of the entire cathode.

In FIG. 1, the tungsten carbide layer 6 is formed on the surface of the small diameter portion 3*a* of the cathode main body portion 3. Moreover, in the case where the emitter portion 4 is joined to the cylindrical portion 3*b* as described above, the tungsten carbide layer 6 is also formed on the cylindrical portion 3*b*. Moreover, although in the above example, an interval is formed between the emitter portion 4 and the tungsten carbide layer 6, they may be provided to be close or adjacent to each other. Also, part of the layer 6 and that of the emitter portion 4 may partially overlap.

Metal oxide on the cathode main body portion 3, in addition to a method of forming the metal oxide layer 6 on the surface of the main body portion 3 as shown in FIG. 2, may be formed by adding approximately 0.5-2 wt % of zirconium oxide ($ZrO_2$), cerium oxide ($CeO_2$), lanthanum oxide ($La_2O_3$), yttrium oxide ($Y_2O_3$), or the like, to the tungsten that forms the main body portion 3, which is the so-called doped tungsten.

An operation of the present invention will be described below. During lighting of a lamp, on the surface of the thorium oxide ($ThO_2$) in Thori-Tun that forms the emitter portion 4, a reduction reaction occurs between that and carbon atoms (C) that are in a solid solution state in tungsten (W), so that carbon monoxide (CO) is produced at the same time the thorium (Th) is produced.

$$ThO_2+C \Leftrightarrow Th+2CO \quad \text{(Eq. 1)}$$

That is, to facilitate the reduction reaction, the carbon (C) is needed around the thorium oxide.

If the tungsten carbide 6, such as $W_2C$ and WC (hereinafter referred to as WxC), is formed on a side face of the cathode main body portion 3 and since the temperature of the cathode becomes high during lighting of the lamp carbon monoxide (CO) is produced by the following reaction with the metal oxide applied or added to the main body portion 3:

$$zWxC+MyOz \Leftrightarrow zxW+yM+zCO \quad \text{(Eq. 2)}$$

and produced by the following reactions with water vapor ($H_2O$) discharged from the surface of an arc tube during lighting of a lamp, or with oxygen ($O_2$) emitted from an electrode:

$$WxC+H_2O \Leftrightarrow xW+H_2+CO, \text{ and} \quad \text{(Eq. 3)}$$

$$2WxC+O_2 \Leftrightarrow 2xW+2CO. \quad \text{(Eq. 4)}$$

M represents a metallic element such as zirconium (Zr), cerium (Ce), lanthanum (La), and yttrium (Y). Moreover, when the CO diffuses inside the arc tube in a vapor phase state, and a part enters an arc. In the arc, the CO is decomposed due to high temperature so that C+ ions are produced. The C+ ions move to the cathode tip face by electric field in the arc, and part thereof is solid-solved in the tungsten and diffuses from the surface portion to the inside of the cathode emitter portion 4 to be supplied to the surface of the thorium oxide. In this way, in the cathode according to the present invention, when the supply amount of the carbon (C) to the surface of thorium oxide contained in the emitter portion 4 increases, the reduction reaction of the thorium oxide shown in the formula (1) is facilitated.

Description of an example of a method of producing a cathode invention will be given below. A member made of Thori-Tun having a diameter of 10 mm and a thickness of 5 mm and a member made of zirconia tungsten (tungsten to which 0.8 wt % of zirconium oxide is added) having a diameter of 10 mm and a thickness of 20 mm, are prepared. Next, a joining face of the Thori-Tun and that of zirconia-tungsten are put together, and a compressive force of approximately a 2.5 kN is applied thereto in an axial direction in a vacuum. Temperature of the joined part is adjusted to be approximately 2,000 degrees Celsius by heating the joined part by passing electricity therethrough, so that Thori-Tun and the zirconia-tungsten are joined by diffusion bonding for about 5 minutes. A cathode 2 having an emitter portion 4 (Thori-Tun) at the tip and a main body portion 3 (zirconia-tungsten) at a back side is formed by cutting (processing) the material after the diffusion bonding. Next, a tungsten carbide layer 6 having a thickness of about 30 micrometers (μm) is formed by a carburization process on the surface other than that of the tip of the cathode 2, that is, the surface of the cathode 2, for example, the surface located at a portion of about at least 2 mm from the tip surface in an axis direction. In addition, although, in the above-described embodiment, the tungsten carbide layer 6 is formed apart from the emitter portion 4, is described, the emitter section 4 may be covered by part of the tungsten carbide layer 6. Moreover, as described below, a position of the tungsten carbide layer 6 to be provided, is determined depending on the amount of the carbon which evaporates at the temperature.

That is, as the temperature of the portion where the tungsten carbide layer 6 is provided is higher (nearer the tip of the cathode), the amount of C to be sent is larger since formation of CO becomes active. If the amount is too large, much tungsten carbide is formed in the cathode tip face, so that undesired deformation of the cathode tip is brought about by the melting.

As mentioned above, according to the present invention, since formation of CO increases by the reaction of the metal oxide with the tungsten carbide in the cathode main body portion, so that the amount of supply of the carbon to the thorium oxide in the inside of the emitter portion of the cathode increases, whereby the reduction reaction of the thorium oxide in the inside of the emitter portion is facilitated, and the thorium oxide, which exists in the inside of the emitter portion, can also effectively functions. For this reason, since there is no case where thorium oxide only in the surface section of the emitter portion is used, it is possible to prevent the life span from shortening due to depletion of the emitter material. In addition, even in a concrete structure where the emitter portion is joined to the short diameter portion of the cathode main body portion, flicker prevention performance can be realized over a long period of time.

The preceding description has been presented only to illustrate and describe exemplary embodiments of the present short arc type discharge lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A cathode of a short arc type discharge lamp that includes an arc tube with the cathode and an anode are arranged inside to face each other, comprising:

a main body portion made of tungsten; and an emitter portion made of thoriated tungsten that is joined at a tip of the main body portion, wherein a metal oxide other than thorium (Th) is contained in the main body portion, and a tungsten carbide layer is formed on an outer surface of the main body portion.

2. The cathode of the short arc type discharge lamp according to claim 1, wherein the metal oxide is formed by applying a metal oxide layer onto a surface of the main body portion.

3. The cathode of the short arc type discharge lamp according to claim 1, wherein the metal oxide is added to the main body portion.

4. A short arc type discharge lamp comprising the cathode according to claim 1.

5. A short arc type discharge lamp comprising the cathode according to claim 2.

6. A short arc type discharge lamp comprising the cathode according to claim 3.

* * * * *